US006443756B1

(12) United States Patent
Hagmann et al.

(10) Patent No.: US 6,443,756 B1
(45) Date of Patent: Sep. 3, 2002

(54) CONNECTING DEVICE

(75) Inventors: Bernd Hagmann, Geislingen/Steige; Peter Kuhn, Köngen; Othmar Gaidosch, Ostfildern, all of (DE)

(73) Assignee: Hirschmann Electronics GmbH & Co. KG, Neckartenzlingen (DE)

( * ) Notice: Subject to any disclaimer, the term of this patent is extended or adjusted under 35 U.S.C. 154(b) by 0 days.

(21) Appl. No.: 09/831,810

(22) PCT Filed: Aug. 5, 1999

(86) PCT No.: PCT/EP99/05662

§ 371 (c)(1),
(2), (4) Date: Sep. 4, 2001

(87) PCT Pub. No.: WO00/30217

PCT Pub. Date: May 25, 2000

(30) Foreign Application Priority Data

Nov. 14, 1998 (DE) ..... 198 52 489

(51) Int. Cl.[7] ..... H01R 11/20; H01R 4/24; H01R 4/26

(52) U.S. Cl. ..... 439/402; 439/411

(58) Field of Search ..... 439/403, 417, 439/404, 210, 213, 411, 394, 402, 396

(56) References Cited

U.S. PATENT DOCUMENTS

| | | | | | |
|---|---|---|---|---|---|
| 3,982,319 | A | | 9/1976 | Bice | |
| 4,087,150 | A | * | 5/1978 | Kubik | 439/397 |
| 4,533,201 | A | * | 8/1985 | Wasserlein, Jr. | 439/391 |
| 4,662,699 | A | * | 5/1987 | Vachhani et al. | 439/392 |
| 5,044,978 | A | | 9/1991 | Gelin | |
| 5,096,437 | A | * | 3/1992 | Levy | 439/411 |
| 5,120,246 | A | * | 6/1992 | Knox | 439/402 |
| 5,306,870 | A | * | 4/1994 | Abat | 174/65 R |
| 5,514,006 | A | * | 5/1996 | Getselis et al. | 200/51.17 |
| 5,934,930 | A | * | 8/1999 | Camps et al. | 439/403 |
| 5,961,341 | A | * | 10/1999 | Knowles et al. | 439/403 |
| 5,989,056 | A | | 11/1999 | Lange et al. | |
| 6,077,122 | A | * | 6/2000 | Elkhatib et al. | 439/608 |
| 6,338,643 | B1 | * | 1/2002 | Miller et al. | 439/417 |
| 6,364,690 | B1 | * | 4/2002 | Nehm-Engelberts | 439/394 |

FOREIGN PATENT DOCUMENTS

| | | | | |
|---|---|---|---|---|
| DE | 195040 13 CI | | 7/1996 | |
| DE | 195 04 013 C1 | * | 7/1996 | H01R/4/24 |
| DE | 297067 33 UI | | 9/1998 | |
| EP | 0 163 361 A1 | * | 2/1985 | H01R/9/05 |
| GB | 1239738 | | 7/1971 | |
| GB | 1464817 | | 2/1977 | |
| WO | WO 97/06580 | | 2/1997 | |

* cited by examiner

*Primary Examiner*—P. Austin Bradley
*Assistant Examiner*—Edwin A. Leön
(74) *Attorney, Agent, or Firm*—Fulbright & Jaworski LLP

(57) ABSTRACT

A connecting device (1) for electrically connecting to at least two electrical conductors (39, 49) in a housing (2) having a tubular connecting plug (3), with a contact holder (10) in the tubular connecting plug (3), the contact holder (10) having contact elements (12) passed through recesses (14) in conductor holders (5) to make contact with the conductors. The connecting device (1) can be expanded into an array of connecting networks with, for example, plug-in connectors, cable bolted assemblies and connecting elements.

29 Claims, 6 Drawing Sheets

CONNECTING DEVICE

BACKGROUND OF THE INVENTION

1. Field of the Invention

The present invention relates to a terminal device usable to make connections to conductors. More particularly, the present invention relates to a terminal device/connecting device for electrically connecting to at least two electrical conductors in a housing having a tubular plug, with a contact holder in the tubular connecting plug, the contact holder having contact elements passed through recesses in conductor holders to make contact with the conductors.

2. Description of the Related Technology

A terminal device already known is described in DE-195 04 013 C1 (see especially FIGS. 13–16). The subject matter of this device is mainly a reusable tap to continuous multi-wire lines, preferably on two-wire profiled flat ribbon cables (ASI lines) with current-carrying flexible leads, for example for measurement purposes at different points of the ASI lines. To connect the ASI line to a branching line the latter is inserted through a connecting sleeve into the housing in which the correspondingly shaped contacts (FIG. 17) connect the wires of the ASI line to the pertinent wires of the branch line.

In particular, as a result of the different terminals of continuous and branching lines the structure of the terminal device for a connection device of this type is complex. Moreover the contact elements which are to be equipped with penetration spikes as well as with an insulation piercing connecting device are complex parts which moreover need be guided very accurately in order to enable simultaneous contact-making of the wires of ASI and branch line.

With this at least alignment assumption, secure installation and function are not guaranteed because the wires of the branch line are not reliably guided and their location can be checked when the contact carrier is being inserted when using transparent material, but can easily deviate from the desired position.

In addition, the required supports represent additional cost for support of the wires of the branch line. Furthermore, the known device is neither intended nor suitable for accommodating electrical devices such as plug-in connectors or branch connecting sleeves.

Finally, the terminal device which had been published previously is not suited for building connecting structures by joining several identical devices, but in any case for connecting two ASI lines if the branch line on the free end does not have an actuator or sensor as provided in column 6, lines 13–14 of the patent, but via another PG gland is inserted in the threaded connecting sleeve of a second terminal device as shown in FIGS. 13–16 and is electrically connected therein to an ASI line.

SUMMARY OF THE INVENTION

An object of the present invention is therefore to devise a terminal device of the initially mentioned type as simple and economical as possible, which enables reliable mechanical and electrical connection of the wires of at least two cables to be connected to contacts of plug-in connectors which are located in the threaded connecting sleeves of the terminal device and to other terminal devices.

This object is achieved by providing conductor holders in tubular threaded connecting sleeves with recesses that extend into the conductor holders to axial channels where conductors are positioned so that contact elements are guided through the recesses to contact-making sites in the axial channels where electrical connections to conductors are made.

The conductor holder of the present invention enables simple, economical and mainly stable positioning of the conductors in the terminal device for absolutely reliable contact-making with the contact elements which are inserted transversely thereto and thus enables prompt and reliable installation. To do this first of all the conductors must be inserted into the holes of the conductor holder and this unit inserted into the intended threaded connecting sleeve and then the contact elements are pressed through the recesses which run transversely to the holes. A visual inspection is unnecessary since the conductors and the contact elements are guided on all sides.

The conductors can advantageously be both conductor wires and also metal parts matched to the requirements of the respective application. Since to connect cables their end parts must be stripped to be able to insert the wires into the holes of the conductor holder, the terminal device is suitable both for round and flat cables.

Since the terminal device is intended solely for conductor connections and not for taps, the contact elements can be made simple, and when penetrating spikes are omitted, can be made both for contact-making of flexible lead and also of solid conductors.

The housing of the terminal device can also be made and produced more simply because supports or rests for conductors which are to make contact with one another are unnecessary. The uniform use of conductor holders for each connection moreover dictates a structure of the terminal device which is simpler and more economical than in the described prior art.

Furthermore, with a terminal device a larger number of connections is possible and depends on the number of threaded connecting sleeves provided. In practice this number is limited by the allowable maximum dimensions of the terminal device. A structure which is suitable for many applications has four threaded connecting sleeves. A favorable compromise being achieved between the size of the device and the number of possible connections.

One special advantage of the terminal device of the present invention lies ultimately in that it is suitable as a module for building any number of connecting structures. To do this only the terminals of at least one threaded connecting sleeve need be connected to each of several terminal devices. Together with the internal connections of each terminal device, complex connecting networks which can be optimally matched to the circumstances of each individual case can thus be built and they moreover can be modified and expanded at any time.

Advantageous embodiments of the terminal device of the present invention are described below.

The arrangement of one conductor holder per threaded connecting sleeve of the present invention very easily makes it possible to provide different arrangements for connection which can be easily joined via the conductors to be inserted into the channels of the conductor holder.

At least a cable gland, plug-in connector, or connecting piece with multiple conductor holder can be attached alternatively to the threaded connecting sleeve, by which a large diversity of possible terminal devices which thus have high utility can be achieved.

Thus, the terminal device can be made for example as a pure cable connector of three or four cables, for which in each threaded connecting sleeve there is one cable gland and the wires of each stripped cable end are placed in the pertinent conductor holder.

It is also possible to install in a threaded connecting sleeve a plug-in connector for connecting a mating connector, for example a cable set. In doing so the plug-in contact elements can be connected via individual conductors such as flexible leads, solid wires or tailor-made metal parts, but also via the conductors of cable pieces stripped on the ends or via conductors which are permanently connected to the plug-in contacts and which on the other end can be inserted into the channels of the conductor holders provided for this purpose.

Another especially feasible means consists finally in the indicated connecting piece which is simple to build and install and enables prompt joining of the terminal devices of the present invention into mechanically stable units.

Making the conductive connection of the two conductor holders of the connecting piece by use of spring-elastic sheets results in a mechanically durable connection which can be easily produced and installed by machine which moreover ensures not only a permanently reliable connection between the connected terminal devices, but also high quality contact-making with the contact elements adjoined by the metal part under spring pressure.

To do this the contact elements can be selectively made as pins or spikes which can be inserted between the sheets or as legs for example of the contacts of the insulation piercing connecting device surrounding the sheets. Also a mixed execution of the contact elements is of course possible.

Making the contact elements as insulation piercing connecting devices is especially advantageous since the reliable contact-making is thus largely independent of the type of conductor. As mentioned, insulated and uninsulated flexible leads, solid wires or other metal parts which are rigid or elastic in the contact area are equally well suited.

Especially fast and uncomplicated installation of the terminal device is achieved in that the conductor holder, regardless of the devices to be connected, are identical. This obviates not only the necessity of assignment to the different devices, but also making available and storing different conductor holders are unnecessary.

In terminal devices with two conductor holders which are not located opposite one another or for more than two conductor holders, the use of mating overlapping end parts on the conductor holder end faces offers the advantage of small dimensions of the housing due to shorter threaded connecting pieces and in addition of the cross section of the terminal plug since the contact elements can be located in a narrow space. The possibility of overlapping is dependent on the number of conductor holders and contacts per conductor holder. With reasonable cost this execution can be easily accomplished for up to four threaded connecting sleeves with two-pin terminals.

Greatly simplified installation, especially in an embodiment of the conductor holder with mating overlapping end parts, is achieved by coding for correct-angle insertion of the conductor holders into threaded connecting sleeves which allows insertion of the conductor holders into the threaded connecting sleeves in only a single position which can also be found "blind".

One possible embodiment of this coding is to use flattened surfaces on the exteriors of conductor holders and on the interior surfaces of threaded connecting sleeves. For example, by having the flattened surfaces area extend only over a portion of the longitudinal length of the conductor holder has the additional advantage that a projection is formed without added costs, which can be used as a stop in the insertion of the conductor holder into the threaded connecting sleeve. Moreover the flattened areas also cause effective locking.

Funnel-shaped insertion openings of the channels enables easy insertion of the conductors.

A quite significant facilitation of installation is achieved by a clamping element which can be active in each channel. When connecting for example one cable first the cable wires can be inserted into the channels and this unit can then be inserted into the pertinent threaded connecting sleeve in any sloped position without the fear of the conductor holder sliding out of the conductor ends or without special aids being necessary to prevent this sliding out. Rather as a result of the light clamping of the cable wires the indicated unit is premounted and then can be easily inserted in the threaded connecting sleeve when this takes place from top to bottom.

A spring tongue which is produced integrally together with the conductor holder in an injection molding process for example is economical and has sufficient spring action even for relatively thick and inelastic plastic.

In practical application a shielded version of terminal devices is often necessary.

In the cable gland the conductive connection of the cable shield to the metal housing takes place via an annular metal spring which adjoins the cable shield and via a metallic thrust collar which adjoins the metal housing and which is conductively connected to the spring.

In a connected plug-in connector with an outside sleeve of conductive material this and/or a plug-in contact at ground potential is connected to the metal housing via a metal piece.

A connecting piece for this purpose has an annular metal piece on the periphery which when union nuts are screwed to the two metal threaded connecting sleeves to be joined adjoins the latter.

Feasibly these conductive connections are made such that they are also effective in a plastic-spray coated metal housing.

In another embodiment of the invention there is on the contact carrier in the threaded plug a circuit board on which not only economical conductive connection of the contact elements intended for this purpose by simple printed conductors can be effected, but in addition also the connection of electrical components, for example a terminating resistor, is easily enabled.

The threaded plug is opened for inserting, connecting and wiring of the printed boards and can be closed by means of a screw-on cover.

BRIEF DESCRIPTION OF THE DRAWINGS

The invention is detailed below using two embodiments of a terminal device and a connecting structure formed from two terminal devices.

DETAILED DESCRIPTION OF THE INVENTION

The same parts in the two embodiments are provided with the same numbers.

Figure 1:
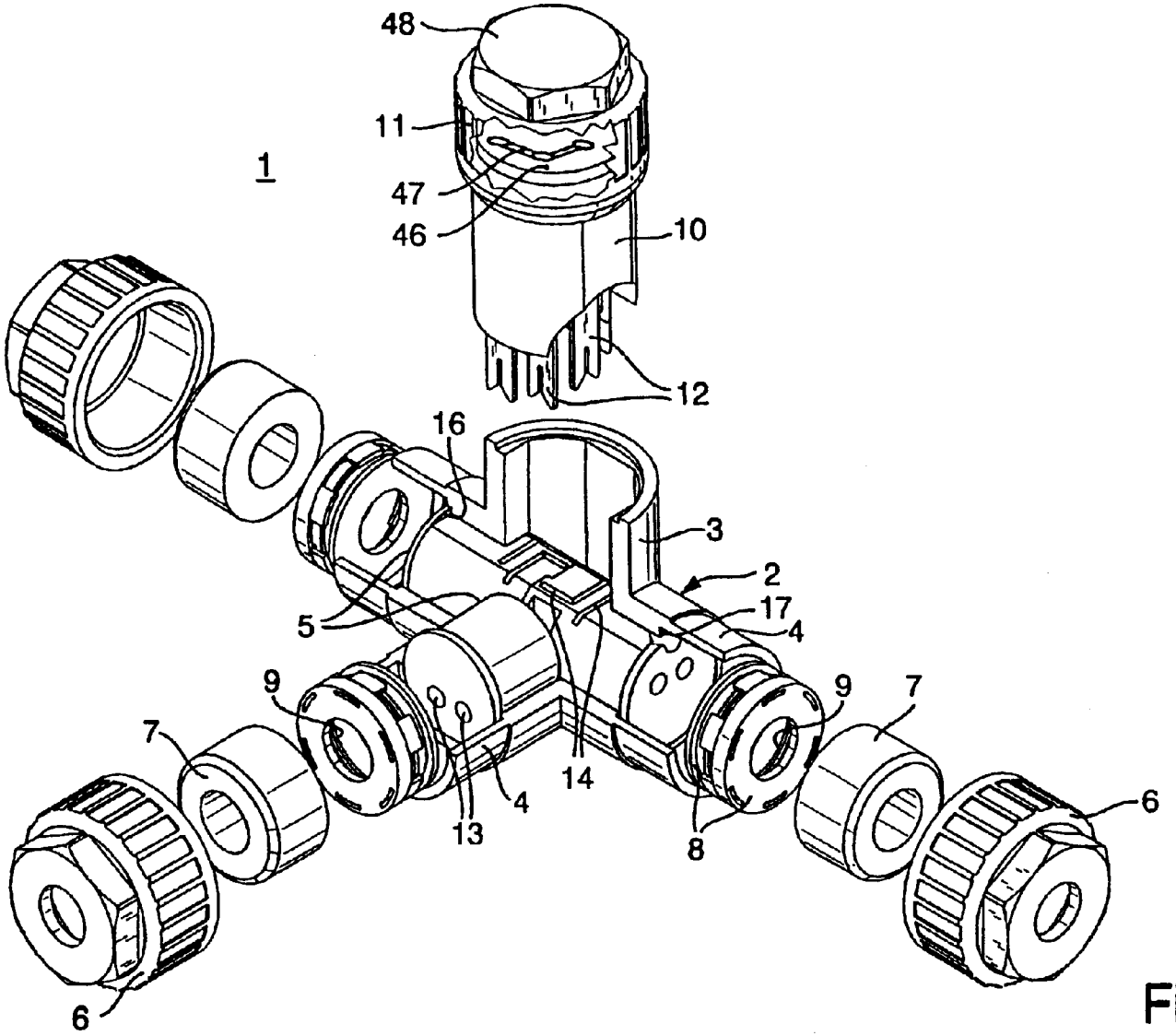
FIG. 1 shows a partially exposed perspective exploded view of a first terminal device for a pure cable connection.

The terminal device 1 shown in FIG. 1 has a T-shaped metal housing 2 with a terminal plug 3 and three threaded connecting sleeves 4 for holding one conductor holder 5 produced from insulating material at a time, and a cable gland which consists of a threaded sleeve 6 which can be screwed onto the threaded connecting sleeve 4, a gasket 7 and a helical spring 9 which is bent in a ring shape, which is located between two thrust collars 8 and which when the gable gland is tightened is pressed on the conical inner surfaces of the thrust collars radially inside against the shield of a shielded two-wire cable which is not shown and in doing so on the one hand causes tension relief of the cable and on the other hand establishes a conductive connection of the cable shield via a metallic thrust collar 8 to the metal housing 2.

A contact carrier 10 of insulating material which can be attached by a screw-on union nut 11 is inserted into the terminal plug and bears the contact elements made as the contacts 12 of an insulation piercing connecting device for conductive connection of the pertinent cable wires.

The other end of the contacts 12 of an insulation piercing connecting device are soldered to the terminal points of a printed circuit board 46 which are linked by printed conductors 47 and in this way effect the desired conductive connections of the pertinent contacts 12 of an insulation piercing connecting device.

The terminal plug 3 is closed with a screw-on cover 48 which can be screwed off for access to the printed circuit board for soldering or connecting electrical components, for example a terminating resistor, or also for measurement purposes.

For the sake of clarity the threads of the terminal plug 3 and the threaded connecting sleeve 4 are not shown.

The three conductor holders 5 each have two channels 13 for holding two cable wires and two slotted recesses 14 located perpendicular thereto for insertion of the contacts 12 of an insulation piercing connecting device and for making contact of the cable wires in the crossing area 32 of the channels 13 and the recesses 14.

The end parts of the cylindrical conductor holders 5 facing one another are semicylindrical and made such that they join one another overlapping and toothed in the connecting or contact-making area of the terminal device 1, the two conductor holders 5 which are located axially flush conversely being inserted in the same angular position and the conductor holder 5 which is located perpendicular thereto conversely being inserted turned by 180°. In this way a minimum space requirement for the connecting area and the terminal plug 3 is formed and a small housing size is achieved.

For quick insertion into the threaded connecting sleeves 4 in the desired angular position the conductor holders 5 each have a flattened area 15 which interacts with the corresponding surface of the inner wall of the threaded connecting sleeve 4. The flattened area 15 is not routed entirely to the cable-side end so that a projection 16 remains which for the conductor holders 5 which have been inserted into the desired position strikes an annular shoulder 17 of the threaded connecting sleeve 4.

The flattened area moreover forms an effective anti-rotation element.

Figure 2:
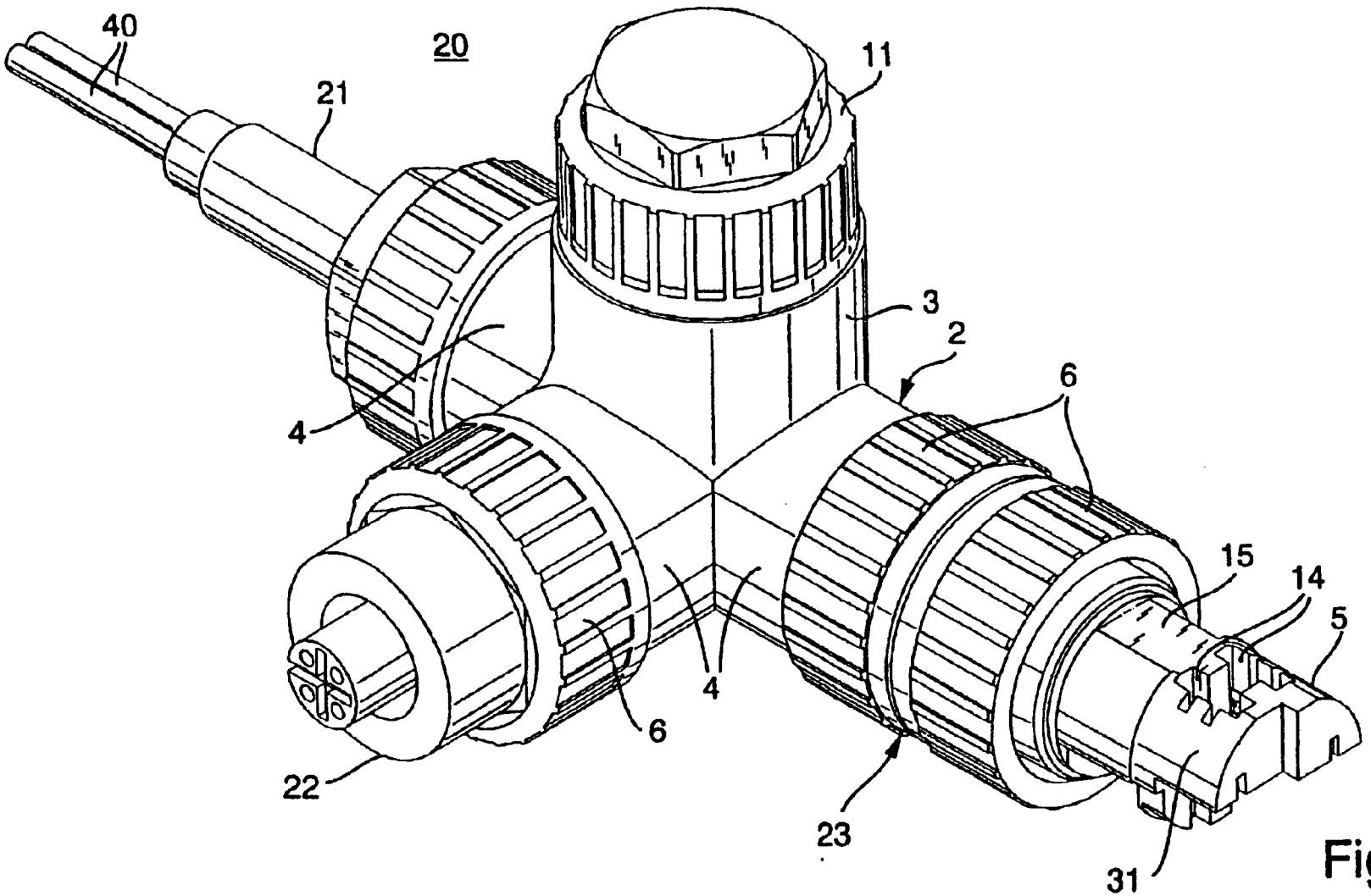
FIG. 2 shows a perspective view of a second terminal device equipped with three different terminal devices.

In the second embodiment as shown in FIG. 2 the terminal device 20 is equipped with a cable gland 6–9 (see FIG. 1) for tension relief of a two-wire cable 21, a four-pin plug-in connector 22 and a connecting piece 23 which has two conductor holders 5 securely joined to one another with one threaded sleeve 6 each.

Each of the identically made conductor holders 5 has a cylindrical section 30 and a semicylindrical section 31 which projects into the connecting area of the terminal device 1, 20.

The slotted recesses 14 for inserting the contacts 12 of an insulation piercing connecting device are perpendicular to the axis of each conductor holder 5, the channels 13 for inserting the conductors penetrate the cylindrical section 30 and the semicylindrical section 31 to be shortly in front of its free end. The crossing areas 32 of the channels 13 and the recesses 14 form the contact-making points where the legs of the contacts of an insulation piercing connecting device are pressed against the conductors under pressure.

For easier insertion of the conductors into the channels 13, they are provided with funnel-shaped insertion openings 33.

Moreover, from the inside walls of the channels 13 one spring tongue 34 projects which has one free end, which is pre-arched to the inside and which is integral with them. These tongues clamp the conductors which are inserted into the conductor holder 5 during installation and which thus together with the conductor holder can be inserted easily and independently of the location of the terminal device 1, 20 into the pertinent threaded connecting sleeve 4.

The two conductor holders 5 of the connecting piece 23 are mechanically connected securely to one another by a metal ring 35. They have two annular collars 36 for holding the threaded sleeves 7 to be able to pivot axially-securely and moreover when the connecting piece 23 has been installed they form the metallic connection of the screwed-together housing 2 of the two terminal devices 1, 20. Two gaskets 37 provide for a water-tight connection.

For electrical connection there are two metal parts 39 which each consists of two sheet metal parts 38 (shown by the broken line in the area which is not visible) and which are guided through the inner cavities of the connecting piece 23. At the crossing areas 32 the sheet metal parts 38 are spaced apart, the distance being somewhat greater than the clearance of the legs of the contacts 12 of an insulation piercing connecting device so that they adjoin the conductors which have been formed in this way under pressure.

In the case of a cable terminal the insulated individual wires 40 of the stripped cable 21 represent the parts which are generally called conductors.

When a shielded plug-in connector 22 is joined to a threaded connecting sleeve 4 (FIGS. 2 and 3) the shielding and the ground connection to the metal housing 2 are accomplished via a pot-shaped metal piece 41 which with the plug-in connector 22 installed adjoins under pressure the face shoulder 42 of the pertinent metal housing connecting sleeve and with a peg which is not shown is connected to the ground terminal of the four-pin plug-in connector 22. The conductors which are not visible for connecting the other three clamp terminals of the plug-in connector 22 to the pertinent contacts 12 of an insulation piercing connecting device are made here as insulated individual wires which are inserted into the channels 13 of the conductor holder 5.

Figure 3:
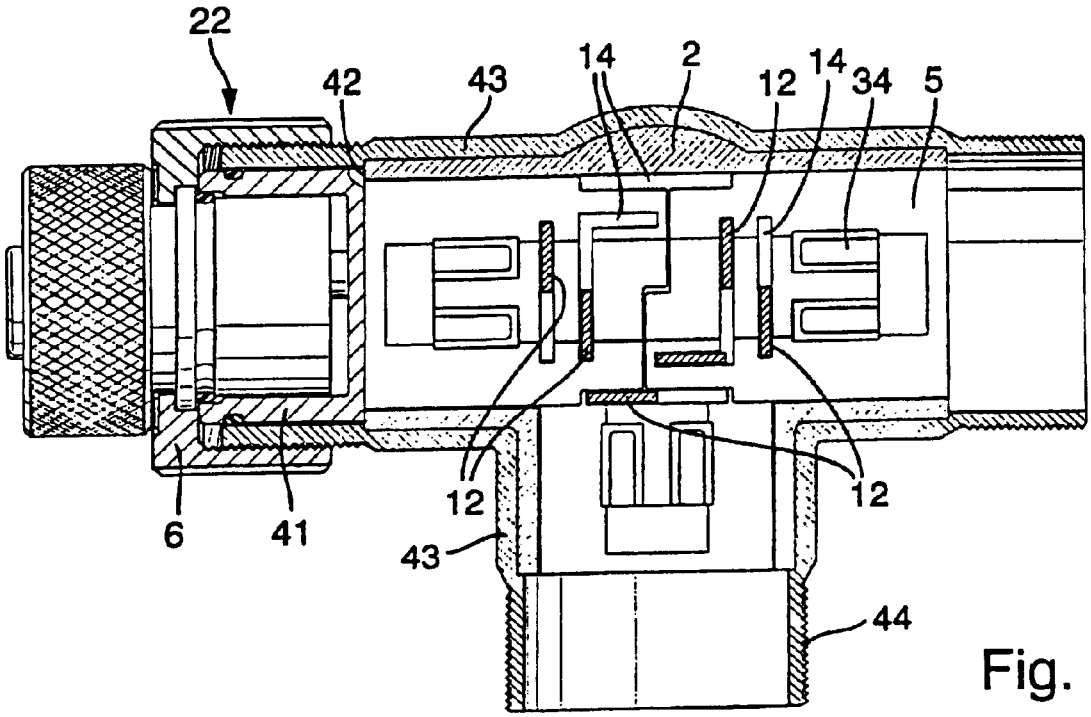
FIG. 3 shows a partially cutaway overhead view of the second terminal device with one assembled terminal.
Figure 4A:
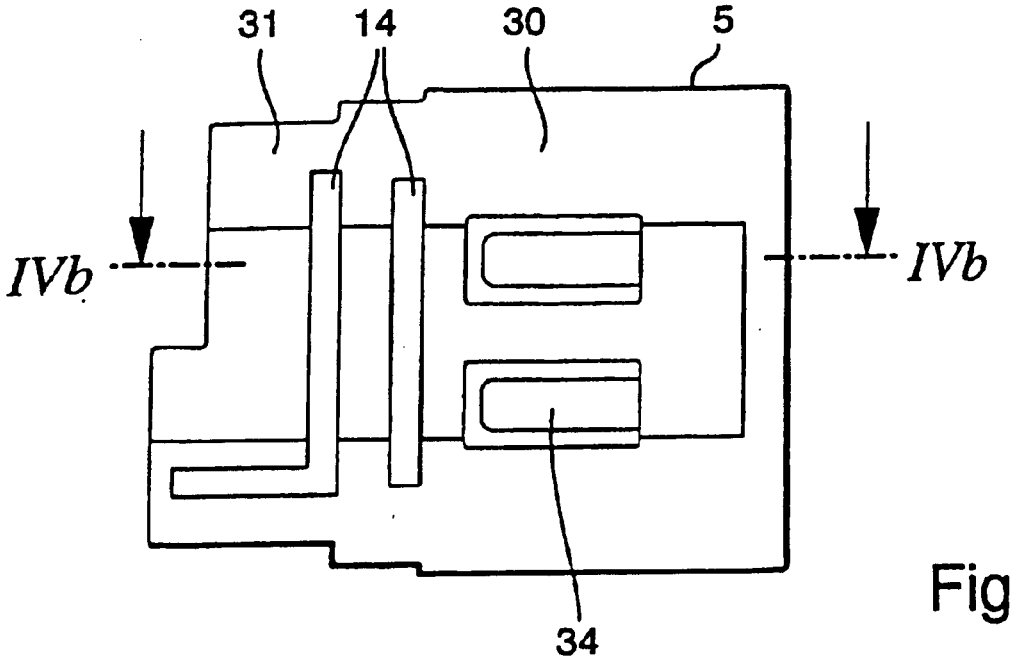
FIG. 4 shows a conductor holder in one view (FIG. 4*a*) and as a section AB (FIG. 4*b*)
Figure 4B:
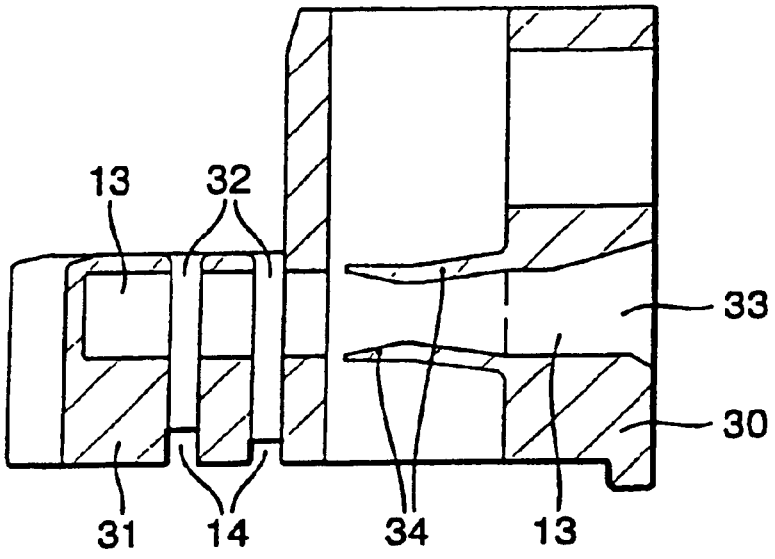
Figure 5A:
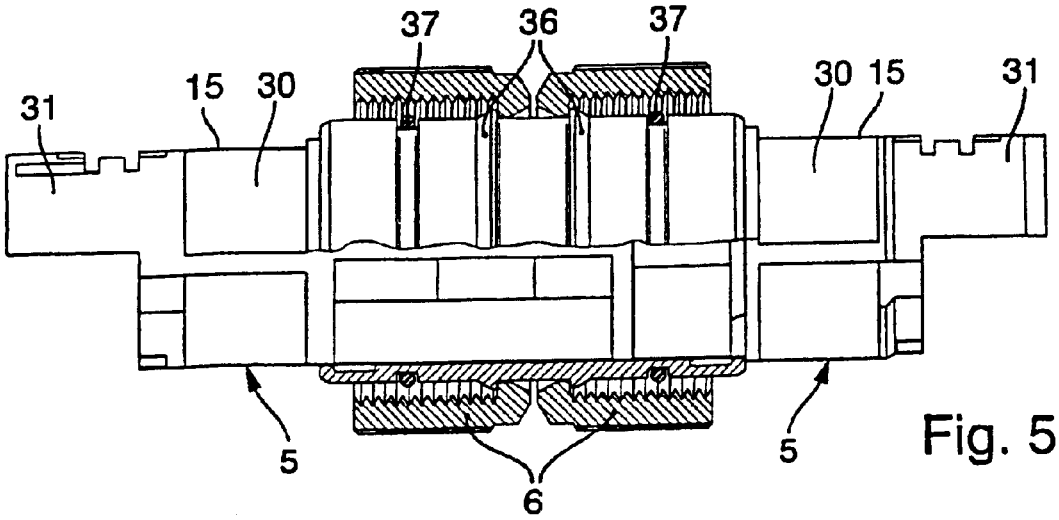
FIG. 5 shows a partially cutaway side view (FIG. 5*a*) and an overhead view (FIG. 5*b*) of a connecting piece; and, FIG. 6 shows a perspective view of a connecting structure composed of two terminal devices.
Figure 5B:
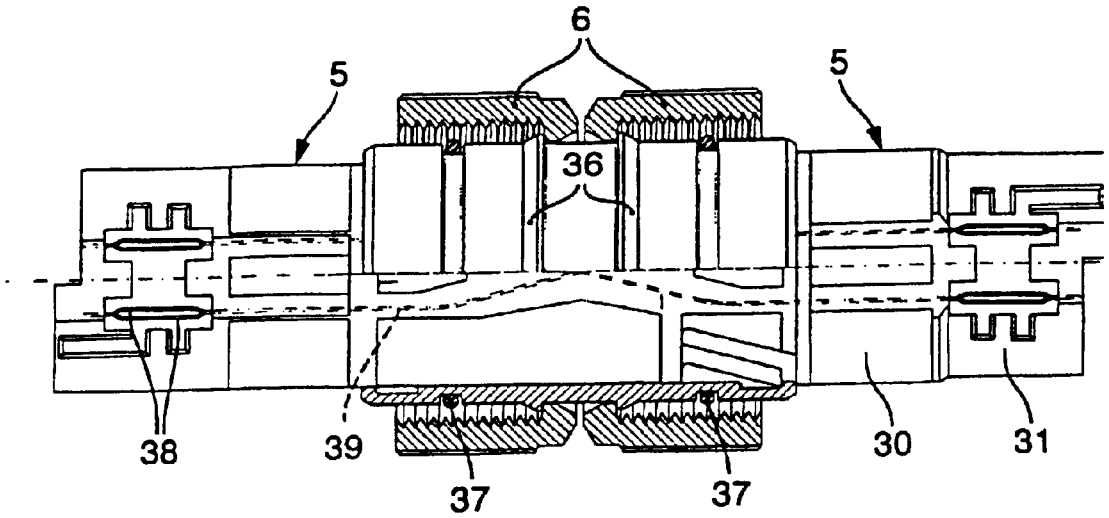

The metal housing 2 in the embodiment of the terminal device as shown in FIG. 3 is provided with a sprayed-on plastic coating 43 which projects over the housing connecting sleeve and bears the thread 44 for screwing on a threaded sleeve 6 of the plug-in connector 22 and two other means which are not shown (connecting piece and/or cable gland).

Figure 6:
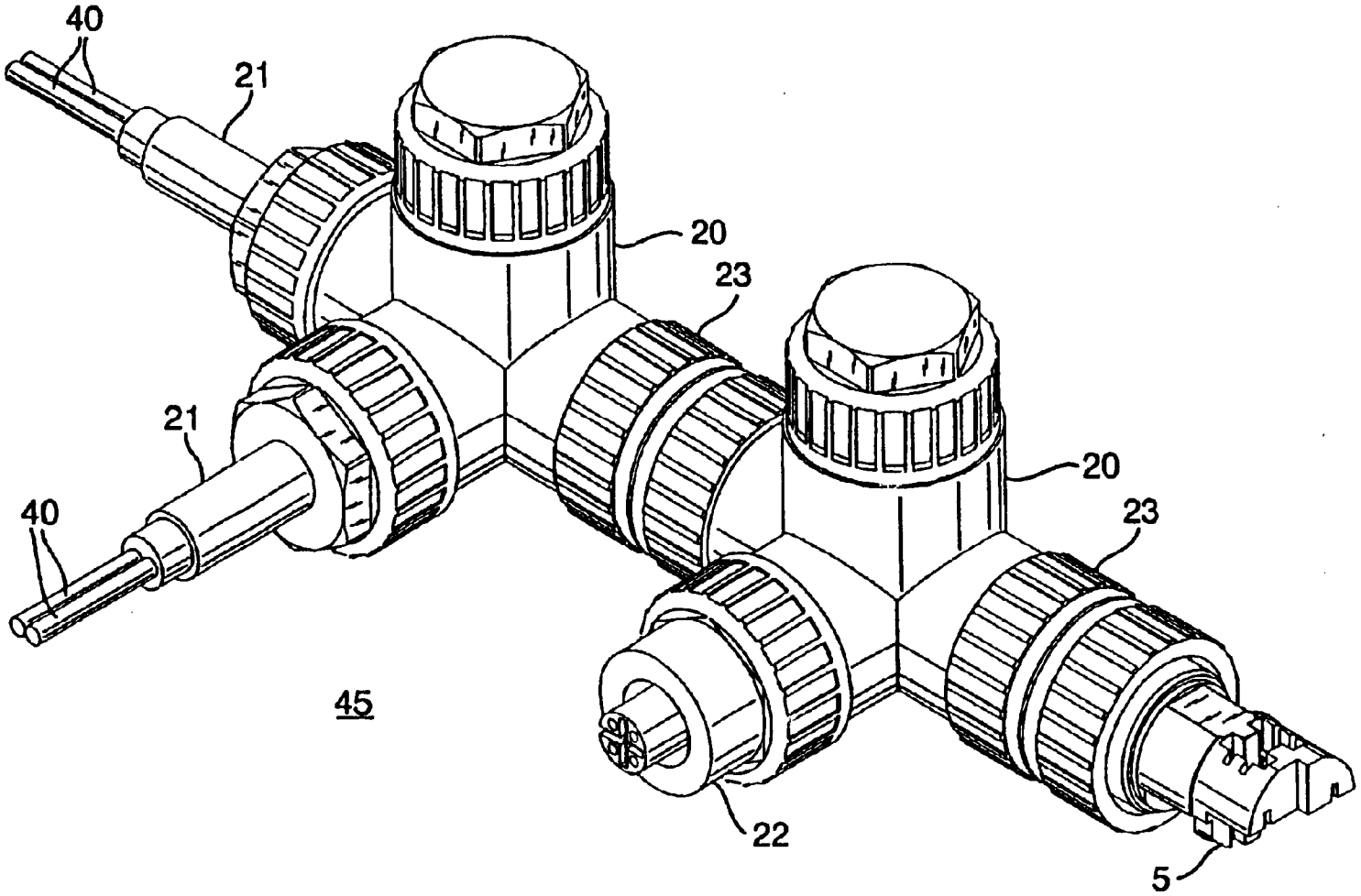

In FIG. 6 two terminal devices 20 with three threaded connecting sleeves 4 each are coupled together via a connecting piece 23 in the manner of a module to a connecting unit 45 in which the wires 40 of the two cables 21 are connected to the contacts of one plug-in connector 22 and which is prepared for further expansion into a connecting network of any degree of branching with different connected devices by other connection pieces 23.

What is claimed is:

1. A connection device for making electrical connections to a plurality of electrical conductors comprising:

a housing including a tubular connection plug having at least two outwardly projecting tubular threaded connecting sleeves disposed from said connection plug;

a conductor holder disposed in each of the connecting sleeves with each of said conductor holders having at least one axial channel in which a conductor can be disposed, each of said conductor holders extend into a connecting area in said housing, at least one recess is provided into each of said conductor holders, said recesses extend from said connecting area into said conductor holders and are transverse to the axial channels to form contact-making sites in said axial channels; and a contact carrier disposed in said connection plug, said contact carrier including at least two contact elements disposed to extend from said contact carrier into the connecting area of said housing, each of said contact elements extend into a recess and connect to one of said conductors.

2. The connection device of claim 1, wherein said connection plug further includes a threaded sleeve.

3. The connection device of claim 1, wherein both said contact carrier and connection plug are coded to each other to have each of said contact elements aligned for insertion into the recesses in said conductor holders.

4. The connection device of claim 1, further comprising a cable gland attaching a cable with a conductor to one of said threaded connecting sleeves.

5. The connection device of claim 1, further comprising a plug-in connector with connecting clamps disposed from one of said threaded connecting sleeves.

6. The connection device of claim 1, wherein the contact elements include insulation-piercing connection devices.

7. The connection device of claim 1, wherein the conductor holders are identically configured.

8. The connection device of claim 1, wherein multiple conductor holders have end faces which when disposed against one another have overlapping end parts to provide a mating union of said conductor holders in said connecting area.

9. The connection device of claim 1, wherein said first flattened surface area extends over a portion of the external surface of said conductor holder but not over an entire longitudinal length of said conductor holder.

10. The connection device of claim 1, wherein an end of at least one of said axial channels that is opposite said connecting area has a funnel-shaped insertion opening.

11. The connection device of claim 1, further comprising a first conductor holder and a second conductor holder disposed in a connecting piece, said first and second conductor holders being in contact with each other and having a first conductor disposed in a first axial channel in said first conductor holder with a second conductor disposed in a second axial channel in said second conductor holder with said first and second conductors electrically interconnected to each other, and said connecting piece disposed from one of said threaded connecting sleeves.

12. The connection device of claim 11, wherein said connecting piece includes at least two disposed threaded connecting sleeves.

13. The connection device of claim 11, wherein the electrical interconnection of said first and second conductors is made by electrically conductive spring-elastic sheets.

14. The connection device of claim 1, wherein the conductor holders and threaded connecting sleeves are coded to provide specific angular orientations for insertion of the conductor holders into the threaded connecting sleeves.

15. The connection device of claim 14, wherein the coding includes first flattened surface areas extending over external surfaces of conductor holders and the corresponding coding for said threaded connecting sleeves includes second flattened surface areas extending over a portion of interior surfaces of said threaded connecting sleeves so that said first and second flattened surfaces are in contact when said conductor holders are inserted into said threaded connecting sleeves.

16. The connection device of claim 1, wherein each axial channel includes at least one clamp element disposed to project into the axial channel from a channel wall.

17. The connection device of claim 16, wherein each clamp element includes a clamp spring having one free end that is pre-arched into the inside of the axial channel.

18. The connection device of claim 16, wherein each clamp element is integral with at least one of said conductor holders.

19. The connection device of claim 1, wherein the housing is metal.

20. The connection device of claim 19, wherein the housing is conductively connected by a gland to a shield portion of at least one shielded cable.

21. The connection device of claim 19, wherein the housing is conductively connected by a metal piece to a grounded plug-in contact of a plug-in connector.

22. The connection device of claim 19, wherein the metal housing is conductively connected by one metal part of a connecting piece to a second housing made of metal.

23. The connection device of claim 19, wherein the housing has a plastic coating.

24. The connection device of claim 22, wherein said first and second housings have plastic coatings.

25. The connection device of claim 1, wherein said contact carrier in said tubular connection plug includes a mounted printed circuit board that is electrically interconnected to at least two contact elements.

26. The connection device of claim 25, wherein electrical components are disposed on the printed circuit board and said electrical components are interconnected to at least two of the contact elements.

27. The connection device of claim 25, wherein said tubular connection plug includes a screw-on cover disposed to enclose the printed circuit board.

28. A method for making electrically connections to a plurality of electrical conductors comprising the steps of:

providing a housing including a tubular connection plug and at least two tubular threaded connecting sleeves disposed to extend outwardly from said connection plug;

providing a conductor holder disposed in each of the connecting sleeves with each of said conductor holders having at least one axial channel in which a conductor can be disposed, each of said conductor holders extending into a connecting area in said housing where at least one recess is provided from the connecting area into each of said conductor holders, said recesses extending into and being transverse to the axial channels to form contact-making sites in said axial channels; and inserting a contact carrier into said tubular connection plug, said contact carrier including at least two contact elements disposed to be extended from said contact carrier into the connecting area and also into at least two of said recesses for connecting to two or more of said conductors.

29. The connection device of claim 1, wherein a union nut attaches said contact carrier to said connection plug.

* * * * *